US005921976A

United States Patent [19]

Seymore

[11] Patent Number: 5,921,976

[45] Date of Patent: Jul. 13, 1999

[54] PROTECTIVE UNDERGARMENT FOR INCONTINENCE

[75] Inventor: Vergie E. Seymore, 16912 S. Belforest Dr., Carson, Calif. 90746

[73] Assignee: Vergie E. Seymore, Carson, Calif.

[21] Appl. No.: 08/970,818

[22] Filed: Nov. 14, 1997

[51] Int. Cl.[6] ..... A41D 27/12; A41B 9/12

[52] U.S. Cl. ..... 604/385.2; 2/82; 2/73; 2/46; 604/385.1

[58] Field of Search ..... 604/358, 396, 604/385.1, 385.2; 2/46, 73, 82

[56] References Cited

U.S. PATENT DOCUMENTS

| | | | |
|---|---|---|---|
| 2,661,471 | 12/1953 | Neumayer | 2/46 |
| 3,324,480 | 6/1967 | Williams | 2/211 |
| 4,821,342 | 4/1989 | Troyer | 2/82 |
| 5,012,540 | 5/1991 | Hockaday | 5/487 |

*Primary Examiner*—Robert A. Clarke
*Assistant Examiner*—Catherine Cogut
*Attorney, Agent, or Firm*—Fulwider Patton Lee & Utecht LLP

[57] ABSTRACT

A disposable protective undergarment for sufferers of incontinence including an absorbent pad constructed of three layers including and liquid penetrable inner layer, an absorbent core and a liquid impervious outer layer. The pad further includes a pair of oppositely placed front panels attached to a back panel and further includes a waistband to secure the pad to the human body. The undergarment is open vertically along the front between the panels creating a pair of confronting edges. A further embodiment of the present invention may include a longitudinally extending slit approximately half-way up from the bottom edge of the back panel.

14 Claims, 1 Drawing Sheet

PROTECTIVE UNDERGARMENT FOR INCONTINENCE

BACKGROUND OF THE INVENTION

1. Field of the Invention

This invention relates generally to protective undergarments and more particularly to a disposable undergarment which will provide protection against incontinence and can be used in conjunction with other incontinence protective articles.

2. Description of the Prior Art

As our society ages a variety of problems exist which are directly related to the aging process, and therefore these problems become highly relevant to an ever increasing segment of our population. One such problem facing this group is that of uncontrolled discharge of body fluids, specifically known as adult incontinence. Often, as one ages, control over urinary functions become diminished or altogether uncontrollable. With the onset of this condition a variety of problems must be faced by the affected individuals. One potential problem is the extreme embarrassment occasioned by the visible signs of incontinence. The affected individual must also face other problems including damage to clothing, carpets, furniture or automobiles when such items are soiled or rendered unusable due to uncontrolled fluid. Such leakage creates a direct financial burden on the individual for costs associated with cleaning and/or replacement of soiled items.

In the past a variety of efforts have been made to reduce the potential problems of urinary incontinence. Most of these efforts have been focused on basic protection and the immediate collection of fluids from the body. Such efforts have created an industry focused on creating under articles of clothing which are designed to be worn between the body and the individual's underwear. Generally, these efforts have been modeled after two prior art types, the infant's diaper and the female sanitary protective device.

As would be expected, attempts to create an undergarment similar to a child's diaper have not been altogether satisfactory in a variety of regards, specifically because adult requirements are quite distinct from those of an infant. Adults move and function differently from an infant who crawls and partakes in minimal high exertion activities. Adults, including those who experience incontinence, wish to participate in activities such as jogging, biking, tennis and golf, in addition to the daily routines of sitting, walking, and driving all of which are essential elements in an adult's day. An adult who wears a diaper device faces an increased incidence of leakage due to natural body movement experienced through day to day activities. While a parent typically will accept a certain amount of uncontrolled leakage from a child's diaper, it can be easily seen that a similar leakage problem would be highly embarrassing to an adult and a wholly intolerable occurrence.

In the past, attempts to remedy the child's problem have resulted in the creation of additional exterior protection such as rubber pants. However, it will be appreciated that a similar item if worn by an adult would be bulky, uncomfortable and easily detected by others. Such results would be unacceptable to most adults who suffer from incontinence and would only serve to further diminish their personal dignity. Furthermore, experience has shown that even a child's rubber pants are not fool proof.

Other attempts at protecting against incontinence have been modeled after the female sanitary pad. While a modified sanitary pad is less bulky than an adult-diaper, it is generally less effective and more prone to leakage since the protection is not continuous but rather limited to a specified area of one's underwear.

Thus, whether one utilizes the adult-diaper method or takes a chance with the incontinence pad method, the likelihood of leaks and the resulting embarrassment and personal property damage is high. Furthermore, the expense caused by these leaks will typically include cleaning and/or replacement of expensive clothing which, especially in the case of women, is more delicate and may require special cleaning processes. It is therefore even more important to create a satisfactory incontinence protection device which will protect one's clothing and other articles against leakage and the resulting damage to that property.

Whereas infants are typically confined to safe areas such as in play pens, cribs and the like where they, and their wet diapers, can do little or no harm, adults cannot confine themselves in such a manner and if they experience an undesired leak, may incur financial consequences in the form of damage to furniture, car upholstery, carpeting or other extremely costly items. Even a small leak due to a shifted protective device can cause hundreds or even thousands of dollars in damage. It can therefore be readily seen that there exists a need for a protective device which can be worn in addition to the adult-diaper or other primary incontinence protective device, which will protect the wearer against personal property damage or embarrassment and humiliation due to unwanted leaks from these devices.

I have previously experimented with a liner device which comprises a layered pad formed in the shape of a woman's skirt. Such a design included a waistband attached directly to the securing member. This design, however, was oftentimes bulky and did not allow sufficient adjustability. I therefore propose the design of the present invention which includes exceptional protectability with a high level of user comfort.

It will be appreciated that, although the prior art includes devices which protect the wearer from the primary problems associated with incontinence, the present invention improves on these methods by increasing the protection level, in a discreet and unrestrictive manner, and is very cost effective. The present invention will thus allow the wearer to proceed with his or her lifestyle without the worry or embarrassment from leaks and the costly damage to associated clothing or other personal property items.

SUMMARY OF THE INVENTION

The present invention is a protective undergarment designed to be used in conjunction with presently available incontinence devices such as adult-diapers or urine collection pads. More specifically, the present invention is a disposable protective slip or pant liner worn by an adult who experiences bladder incontinence. The garment is designed to protect the wearer from embarrassment, humiliation or costly property damage which can occur when an individual experiences leakage from his or her primary incontinence protective device. The invention is a thin, flexible and disposable yet highly protective shield which prevents leaks from exhibiting itself onto an individual's outer garments. Thus, this invention is also capable of protecting furniture, carpeting, bedding and other items which may come in contact with an individual who may experience a leakage from an incontinence protective device. Furthermore, this invention is designed to be comfortable and discreet, since a wearer forced to exhibit the protective device or to undergo further personal discomfort would be highly unlikely to utilize such an item.

The undergarment is constructed of disposable materials and designed having a liquid impermeable outer layer, an absorbent inner core and a liquid permeable inner layer. The undergarment is designed to complement the lower half of the human form and is configured it to having a back panel attached to two oppositely placed front panels. The front panels are open longitudinally down the center to produce a respective pair of confronting edges which permit the wearer to have convenient access to his or her primary incontinence protective article and yet still provide the necessary protection against leakage. The undergarment is configured having a waistband at the top to enable secure attachment to the wearer and to further enable the user to pull on the undergarment by stepping into the top of the undergarment and then pulling upwards so as to fit the undergarment comfortably at the waist.

The present invention is superior to the independent use of a primary incontinence protection device yet still sustains freedom of movement and comfort to the wearer when used on a day to day basis. This undergarment allows the wearer to be secure in the fact that leakage will not be a problem. The wearer will thus have confidence that the difficulties associated with incontinence will be prevented and yet the present invention will not diminish the individual's current activity levels. Furthermore, the present invention can accomplish these goals with minimal expense or inconvenience.

The three layer construction of the liner provides an undergarment which is flexible, quiet, and virtually invisible under most clothing. Therefore, the presence of the protective undergarment is not readily detectable by other persons even when nearby. Furthermore, the three layer construction acts to draw fluid into the central core yet prohibits the penetration of liquid to the outer garments. This construction retains liquid which may have leaked and prevents it from escape out of the protective pad.

The protective undergarment further incorporates a continuous elastic band contained within a laterally extending tube at the top of the liner. This waistband permits the undergarment to fit comfortably and securely at the waistline. A proper fit is essential since the undergarment will be worn in addition to, and underneath, other clothing thus a thin and comfortable waistband is fundamental for the fit and comfort of the wearer.

In one embodiment the undergarment is further constructed with a centered slit which extends halfway down the back panel to the lower edge of the undergarment. This construction creates the general appearance of two distinct semi-cylindrical sections which can be inserted, one side each, into the pant legs of a pair of trousers. In this way, the two sections will extend into and down the pant legs while still extending forwardly into the crotch region of the trousers to provide complete protection against leakage for the individual wearing pants.

Other features and advantages of the invention will become apparent from the following detailed description, taken in conjunction with the accompanying drawings, which illustrate, by way of example, the features of the invention.

DETAILED DESCRIPTION OF A PREFERRED EMBODIMENT

Figure 1:
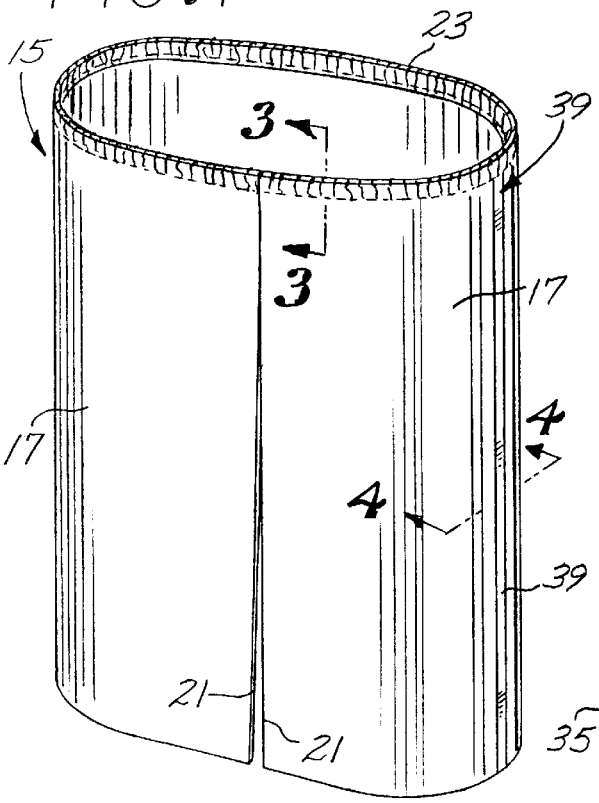
FIG. 1 is a perspective view, of a disposable protective undergarment embodying the present invention.
Figure 2:
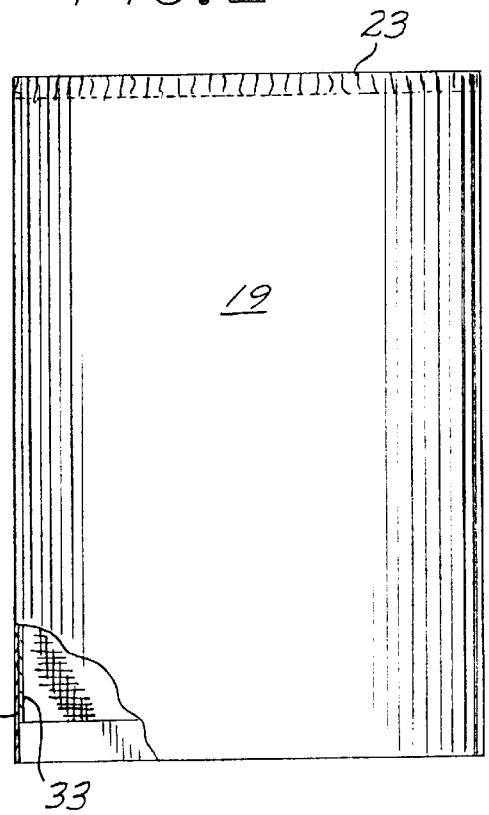
FIG. 2 is a rear view, of the disposable protective undergarment shown in FIG. 1.
Figure 3:
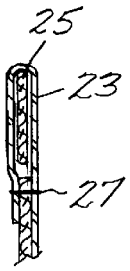
FIG. 3 is an enlarged, cross-sectional view, taken along line 3—3 of FIG. 1, of the waistband incorporated in the disposable protective undergarment of the present invention.

Referring to FIG. 1, the disposable protective undergarment of the present invention, generally designated 15, is generally skirt like and includes a continuous outer layer 35 of moisture impermeable material covering a highly absorbent core 33 of fibrous material and an inner layer 31 which is liquid permeable. The undergarment is of a generally cylindrical shape to form a tubular skirt or pant liner which complements the human form. The undergarment 15 is configured having a back panel 19 with oppositely designed laterally and inwardly turned right and left front panels 17 which terminate in confronting edges 21. The confronting edges 21 are open down the center of the undergarment 15 for easy access to the individual's underwear or adult-diaper. The top of the undergarment and further includes a waistband, designated 23. The waistband 23 comprises a portion of the top of the undergarment 15 which extends upwardly and then folds inwardly and downwardly to form a laterally extending tubular loop which houses an elastic member 25. The protective undergarment 15 is shaped to generally follow the curvature of the human waist and hips and is therefore somewhat gathered at the waistband 23. When worn, the undergarment is slightly narrower at the waist and there is substantial give at the waistband 23. This contouring enables the undergarment 15 to fit snugly on the wearer's waist yet not bind the hip region during activity. Extending vertically along the sides of the undergarment are oppositely placed pairs of adhesive strips 39 which can be used to removably attach the protective undergarment to an individual's outer garment.

As one ages the potential to develop a variety of ailments increases. Such ailments may include an assortment of symptoms some of which are more problematic than others including that of bladder incontinence. However typical such an ailment may be, frequency of occurrence in the population does not in any way diminish the potential embarrassment associated with this problem. If not controlled, an individual would experience humiliation as well as experience soiling of his or her clothing, furniture, automobile, bedding and carpeting, all of which are costly items to clean or replace. Typical designs for bladder control protection have centered around the creation of adult diaper-like devices which are worn to collect urine and protect clothing. From experience with infants and toddlers, one would expect such a device to incur leaks and oftentimes gap in inappropriate places, thereby causing potentially embarrassing leakage. Other designs have looked towards the feminine hygiene industry for guidance and have produced products along the lines of extra large sanitary napkin-like articles which are also designed to collect urine and protect garments. It can be expected that with a decrease in size of the protective device there would be an associated decrease in the effectiveness of the product and thus the potential for leakage is high. Whatever technological advances these two protection methods have produced, experience has shown that either method is still highly likely to leak and cause the associated problems this invention is designed to prevent.

Manufacturers of incontinence protection devices have traditionally focused on the quality and size of the adult-diaper's padding when attempting to remedy this problem. Yet, no matter how absorbent a diaper may be or how secure the fit of the diaper appears, leaks are always a risk, and the odds do not favor the an individual who attempts to go for extended periods of time without experiencing a leak. The risk of embarrassment and monetary loss due to damaged clothing, furniture and the like remains extremely high. What is required is an extra layer of protection which is impervious to the probable shifting of an adult-diaper, which often occurs during activity, and which also protects the wearer against leaks due to extended periods of wear time or a reduced opportunity to monitor the diaper or other primary protective device. Thus, the extra protection embodied in the present invention is ideal for an affected individual since it protects without possibility of leakage and provides continuous enhanced protection throughout the day or night and in a variety of different situations.

To perform these functions I have designed the disposable protective undergarment 15 of the present invention. The undergarment is constructed as a three layered liner having an interior liquid pervious layer 31, a highly absorbent interior core 33 and a fluid impervious outer layer 35. The liner is configured so that when the undergarment is worn the inner layer 31 is directed towards the individual and the outer layer 35 is in contact with the outer garments of the individual. The undergarment 15 itself is constructed to conform to the lower torso of the human body and includes a back panel 19 and a pair of oppositely placed front panels 17. The front panels 17 are formed so that each terminates in respective confronting edges 21. The top edge of the undergarment is constructed having a waistband 23 which is self-adjusting. The confronting edges 21 of the front panels 17 are designed to move freely in a lateral direction to enable the individual to have easy frontal access when appropriate and to enable the undergarment 15 to adjust as required by minor weight changes of the individual or to provide more or less frontal coverage. It can be appreciated that an individual wearing the present invention would primarily require complete coverage in the rear area where leakage is most likely to materialize when sitting or when lying down.

The outer liquid impervious layer 35 is preferably constructed of a thin plastic film, however other liquid impervious materials may be utilized. This outer layer 35 should be flexible and reasonably compliant so that it can conform to the general shape and contour of the human body. Such an outer layer may comprise a variety of disposable materials such as a thermoplastic film or a polypropylene sheet or it may comprise a composite material such as a cloth material coated with a thin film. The preferred embodiment utilizes a disposable outer layer 35 of polyethylene film having of thickness of approximately 1 mm. It will be appreciated by one who is skilled in the art that the relative thickness and type of materials used may vary depending upon the amount of activity the individual wearer expects to conduct and the relative needs associated therewith. An example of the changing needs can be shown by comparing a highly athletic individual who requires a thicker and more durable undergarment with a more sedentary individual whose needs are such that less strength and more compliance would be appropriate. The outer layer 35 may also be textured to enhance the flexibility of the plastic and to provide a more cloth-like appearance. This outer layer acts as a barrier to prevent any fluids which have accidentally leaked from the adult-diaper or incontinence pad from spreading onto the individual's outer garments or damaging any other personal effects.

The inner absorptive core 33, may be constructed of a variety of highly absorbent materials which are capable of absorbing and retaining liquids. This absorbent core 33 is generally constructed having a thickness of 3 mm and maintains a uniform thickness throughout the undergarment 15. It can be appreciated that it may be desirable to utilize an absorbent core 33 having a variety of thicknesses depending on the wearer's needs. Furthermore, one skilled in the art will also appreciate that it may be desirable to have the thickness of the absorbent core vary at different zones within the undergarment 15 to achieve selective absorbency. There are currently available a variety of disposable materials which would be appropriate for use as the absorbent core 33 for the present invention, these may include materials such as commuted wood pulp, cellulose wadding, polyester, tissue, a variety of foams, synthetic absorbent polymers, sponges and the like. It can be appreciated that any number of such absorbent materials, or a combination thereof, may be used to create the thick absorbent core. The preferred embodiment comprises a layer of disposable synthetic absorbent polymers uniformly disposed against the outer fluid impervious layer 35 and joined thereto using an adhesive means.

Figure 4:
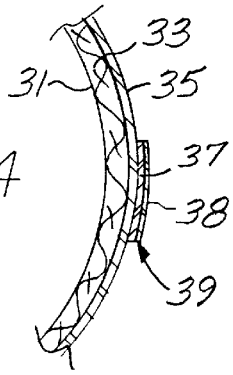
FIG. 4 is an enlarged, cross-sectional view, taken along line 4—4 of FIG. 1, of an adhesive strip incorporated on the disposable protective undergarment of the present invention.

Referring to FIG. 4, the inner layer 31 is generally liquid pervious so as to readily draw fluids into the sheet and direct such fluid to the absorbent core 33 which will thereafter trap the fluid and prevent leaks. The inner layer 31 has a general thickness of 1 mm and may be manufactured from a variety of suitable materials all of which are generally hydrophillic yet sufficiently compliant so as to move freely with the individual wearer. One skilled in the art will generally find as acceptable substances including woven cotton fibers, polyester, or any other combination of natural and/or synthetic materials. The preferred embodiment comprises a compliant woven polyester material which resembles a thin gauze. Such a material is relatively non-absorbent so that when fluids pass through the inner layer 31 and into the absorbent core 33 these same liquids are not permitted to pass back through to re-wet the wearer. This system not only reduces body soiling but also prevents the leak from re-wetting the individual's underwear.

In the preferred embodiment the three layers are combined together into one generally rectangular liner such that the absorbent core 33 is disposed between the outer layer 35 and inner layer 31 and wherein the three layers are secured to each other using any one of a number of commercial adhesives which are well known in the art. The adhesive may be spread in a uniform and continuous layer to attach the absorbent core 33 directly to the outer layer 35. The inner layer 31 is then placed directly on top of the absorbent core 33 and is secured, only at its outer edges, to the outer layer 35. Thus, although the absorbent core 33 is relatively immobile, the inner layer 31 is free to flex and move within its four corners.

In the preferred embodiment the outer layer 35 and the inner layer 31 are approximately one inch longer at the bottom edge of the undergarment 15 and one inch wider than the absorbent core 33 along the confronting edges 21 of the front panels 17. This extra inch of width at the confronting edges 21 extends laterally forwardly and is then turned inwardly and connected to, and covering the inner layer. A thin film of adhesive may be spread uniformly at this fold to maintain the confronting edge. Thus, the inner layer 31 and outer layer 35 produce an edge barrier which further acts to prevent the escape of fluids from the protective undergarment.

It will be appreciated that the overall dimensions of the disposable undergarment may vary depending upon the size of the individual wearer. One size would not appropriately fit all in this case. The most appropriate method for sizing individuals is to provide a variation of small medium and larger size which allow for a certain amount of give to fit a small variety of sizes within a specified range. Thus, the present invention is expected to provide potential users with small choice of sizes and allow the self-adjusting elastic band to expand the fit and comfort levels of each individual wearer.

In the preferred embodiment, as shown in FIG. 1, the top edge of the liner is then folded downwardly and sewn at point 27, such that both inner layers 31 are in direct contact. The top edge is folded so that the sewn point is approximately one inch from the top which creates a laterally extending tubular loop which runs along the top edge of the liner. This tube structure is open at each end. An elastic band 25 is then telescopically inserted through the tube, drawn the length of the liner, and then sewn to itself to thereby create a continuous band. The addition of the elastic band 25 creates a slightly gathered effect along the waistband 23 of the undergarment 15 thereby allowing for an adjustable and yet comfortable fit at the waist and under one's outer garments. It will be appreciated that a variety of materials may be utilized to create an adjustable securing member at the top of the undergarment, however, in practice, the use of a continuous elastic band 25 of a ½" in width has been shown to provide the most comfortable fit and which is also the easiest for the wearer to use.

It will be appreciated that the addition of the elastic band 25 works to form the body conforming structure of the undergarment 15 thereby positioning the back panel 19 and the pair of front panels 17 each having a corresponding confronting edge 21. It will be appreciated that the tubular loop which runs laterally along the top edge of the undergarment 15 is still open at each end thereby allowing the individual wearer free access through the front of the undergarment to facilitate use of a restroom or monitoring of the primary incontinence protective device.

Referring to FIG. 4, the undergarment may further include a pair of adhesive strips, generally designated 39, which have a non-stick, peel-away protective layer 38 which exposes the adhesive 37 when removed. These adhesive strips 39 are approximately ½" in width and a pair of strips 39 are placed vertically down the length of the undergarment 15 and centered where the front panels 17 and the back panel 19 meet. In practice, the top covering 38 of these adhesive strips 39 may be peeled away from the undergarment to expose the adhesive 37 side of the strip. The individual wearer may then apply the adhesive side 37 directly to his or her outer garments to thereby ensure that there is no movement of the protective undergarment 15 during prolonged movement and activity.

In operation, an individual who experiences bladder incontinence and who has found traditional primary incontinence protective devices to be insufficient, may obtain the disposable protective undergarment of the present invention for use in conjunction with his or her primary incontinence protective article. The individual can position front so it is lined up with the individual's torso and then step into the top of the undergarment. You will notice that the flexible elastic band enables the user to ease the undergarment over the hips and buttocks and yet comfortably and snugly position the waistband at the individual's waist. Depending upon the individual, the center front opening may or may not be substantial so as to enable the confronting edges to be in contact with each other. You will observe that the size of the frontal opening and resultant coverage of the front panels may vary with each use. Once the undergarment is securely positioned the individual may then complete dressing by placing their outer garments over the protective undergarment. The claimed invention is discreet and cannot be detected when worn.

Figure 5:
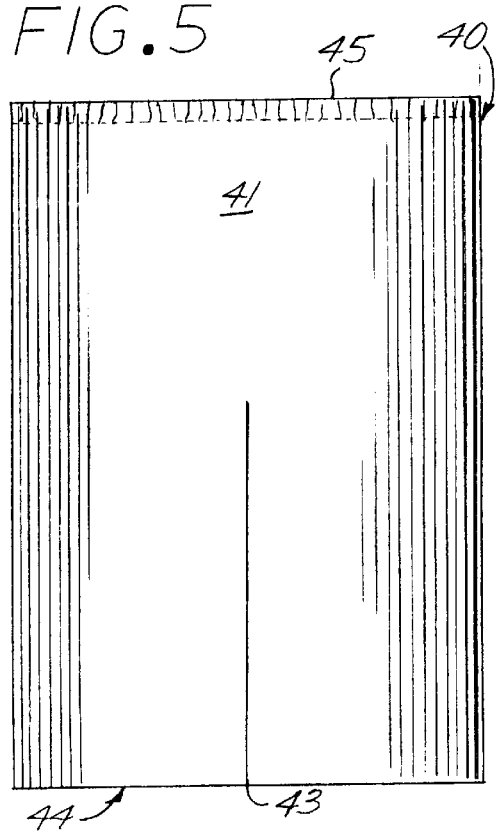
FIG. 5 is a rear view, of a second embodiment which may be incorporated into the disposable protective undergarment of the present invention.

Referring to FIG. 5, a further embodiment of the undergarment 40 is designed for use with trousers. The trouser undergarment 40 is constructed of a three layered disposable liner having a liquid impervious outer layer, an absorbent core and a liquid pervious inner layer and is constructed to conform to the human body and having a back panel 41 and a pair of front panels (not shown). A waistband 45 is utilized to comfortably fit the undergarment 40 at the wearer's waist. This embodiment further includes the addition of an elongated slit 43 in the back panel 41 of the undergarment 40. This slit 43 extends upwardly from the bottom edge 44 of the undergarment 40 to substantially one-half of the length of the back panel 41. This slit thereby creates two semi-cylindrically placed panels for insertion into the legs of a pair of pants.

In use the individual will put the undergarment 40 on by stepping into the undergarment and centering both the confronting edges and the back slit 43. The individual can then, using the waistband 45, pull upwards over the hips and buttocks until the undergarment 40 is securely placed at the user's waist. Trousers can then be pulled on over the undergarment as usual and the protective undergarment 40 can be negotiated into place by first inserting one side of the undergarment into the corresponding pant leg and then placing the other side of the protective undergarment into the remaining pant leg. The combination of the front panels and the back slit 41 enable the undergarment to come into contact with the outer garment throughout the inseam region while still allowing easy access to the frontal region. In this way it can be expected that the affected individual will have continued protection while sitting or moving, yet will have convenient access to his or her underwear or adult-diaper, as appropriate.

Once the undergarment is in place the individual will notice that he or she may go about their day participating in all types of activities and without alerting others to the existence of the undergarment of the present invention. If their primary incontinence protection device leaks or fails in any manner, the present invention will safely protect the wearer's clothing, upholstery, automobile interior, linens and other belongings which are potentially damaged due to incontinence. The undergarment works by drawing any leaked fluid into the absorbent core and away from the wearer while the outer layer prevents any pass-through of fluid to the outer garments. In contrast to a primary incontinence protective device, the undergarment claimed herein provides a large area of continuous coverage and is designed to catch any escaping fluids. It will be appreciated that although the ability to protect against a large variety of potential leaks is crucial, it is not necessary to require the present invention to have the extensive absorbency properties expected in a primary incontinence protection device. The large area of coverage afforded to the wearer by the undergarment is properly capable of absorbing a relatively large volume of liquid if necessary. Thus an individual who faces the potentially expensive and humiliating problem of urinary incontinence can be free from worry and excess costs due to the features of the claimed invention.

From the foregoing, it will be clear that the protective undergarment of the present invention provides optimum protection against leakage or malfunction of a primary incontinence protection article while allowing the individual wearer freedom of movement with comfort and exceptional protection. The undergarment waistband and liner design is constructed to be comfortable during extended periods of use, as well as effective protection against urinary incontinence.

What is claimed is:

1. A disposable protective underskirt comprising:

a generally tubular panel formed at its upper extremities with a turn back belt loop and extending downwardly therefrom to form back, side and front panel sections cooperating to cover the back side and front of a patient;

said panel being constructed of an outer layer of generally moisture impervious sheet, a coextensive inner layer of moisture pervious sheet covering a central layer of a generally absorptive sheet-like inner core sandwiched between said inner and outer layers; and an elastic strap received in said loop and expandable to allow said loop to be adjusted to different waist sizes.

2. A disposable incontinence protective undergarment, comprising:

a tubular absorptive liner constructed of three section;

said sections include a moisture penetrable inner layer a highly absorptive central layer and a moisture impenetrable outer layer;

said liner is configured having a back panel attached to two oppositely designed forwardly placed partial front panels which form said tubular liner;

said front panels terminating in a respective pair of confronting edges;

said liner being further formed with a top edge and a bottom edge, said top edge formed with an inwardly turned downwardly directed segment which is secured to said back and front panels to create a loop;

said top edge being further formed with a plurality of gathers along said loop for easy adjustment and comfort during use; and within said loop is a self-adjusting member for securing said undergarment to an individual to protect an outer garment against undesirable leakage due to incontinence.

3. A disposable protective undergarment according to claim 2 wherein:

said outer layer further includes a plurality of adhesive strips which extend vertically from said top edge to said bottom edge; and said strips are evenly spaced between said back panel and said front panels to enable said undergarment to be secured to said garment to limit movement between said undergarment and said garment during activity.

4. A disposable protective undergarment according to claim 2 wherein:

said self-adjusting member comprises an elastic band having a width no less than ½" thick.

5. A disposable protective undergarment according to claim 2 wherein:

said back panel further includes a longitudinal slit extending upwardly from said bottom edge of said undergarment towards said top edge; and said slit extends no more than one half of the distance between said bottom edge and said top edge.

6. A disposable protective undergarment according to claim 2 wherein:

said pair of confronting edges includes the addition of a portion of said outer layer which extends laterally forwardly and turns inwardly to connect to and cover said inner layer.

7. A disposable undergarment according to claim 2 wherein:

said central layer is substantially shorter in length than said bottom edge of said outer layers and said inner layer.

8. A disposable undergarment comprising:

a generally tubular liner designed to complement the lower half of a human body;

said liner including an absorptive inner layer and a liquid impervious outer layer;

said liner further including a front panel connected to a back panel and having a top and a bottom end;

said top end is formed to turn downwardly and connect to said back and front panels to create a loop which extends along said top end;

said loop includes a member for securing said liner to the body; and said member is self-adjusting.

9. A disposable undergarment according to claim 8 wherein:

said front panel further includes a longitudinal opening extending from said top end to said bottom end; and said opening being centered in said front panel to exhibit a pair of confronting edges.

10. A disposable undergarment according to claim 8 wherein:

said back panel further includes a vertically aligned slit which extends upwardly from said bottom end to substantially one half of the length of said back panel.

11. A protective undergarment, comprising:

a tubular pad constructed of three layers of disposable materials;

said layers include a moisture penetrable top sheet, a highly absorptive core and a moisture impenetrable back sheet;

said pad is configured having a back section connected to a pair of oppositely placed front sections;

said pad being further formed having a top end and a bottom end, said top end providing an opening for a wearer's torso;

said top end includes a self-adjusting member for securing said undergarment to the wearer; and said self adjusting member is housed in a loop.

12. A protective undergarment according to claim 11 wherein:

said top end is further formed having a segment which folds upwardly and inwardly from said top end to turn downwardly and connect with said front and said back sections to cooperate in forming a waist loop; and an elongated securing means received telescopically in said waist loop.

13. A protective undergarment according to claim 12 wherein:

said securing member is in the form of an elastic band;

said elastic band is circular having a width substantially ½" thick.

14. A protective undergarment according to claim 11 wherein:

said back section further includes a vertically projecting slit which extends upwardly from said bottom end to substantially one half the length of said back section.

* * * * *